US006672936B1

(12) United States Patent
Shaffer

(10) Patent No.: US 6,672,936 B1
(45) Date of Patent: Jan. 6, 2004

(54) TOY TRUCK

(75) Inventor: Aaron Shaffer, Stow, OH (US)

(73) Assignee: The Little Tikes Company, Hudson, OH (US)

( * ) Notice: Subject to any disclaimer, the term of this patent is extended or adjusted under 35 U.S.C. 154(b) by 0 days.

(21) Appl. No.: 10/299,115

(22) Filed: Nov. 19, 2002

Related U.S. Application Data

(60) Provisional application No. 60/419,925, filed on Oct. 21, 2002.

(51) Int. Cl.[7] ..... A63H 17/05

(52) U.S. Cl. ..... 446/434; 446/431; 446/465; 280/433

(58) Field of Search ..... 446/434, 431, 446/465, 460, 457, 454, 456, 424, 425, 427, 428; 280/433, 432, 434

(56) References Cited

U.S. PATENT DOCUMENTS

| | | | | | |
|---|---|---|---|---|---|
| 2,201,910 | A | * | 5/1940 | Meienborn | 446/434 |
| 2,233,116 | A | * | 2/1941 | Voorheis | 446/434 |
| 2,602,266 | A | * | 7/1952 | Preston | 446/434 |
| 3,822,501 | A | * | 7/1974 | Kelterstr | 213/75 TC |
| 4,304,066 | A | * | 12/1981 | Brand et al. | 446/434 |
| 4,366,645 | A | * | 1/1983 | Crain et al. | 446/434 |
| 4,372,075 | A | * | 2/1983 | Harkins | 446/434 |
| 4,512,483 | A | * | 4/1985 | Crossley et al. | 213/75 TC |
| 4,516,948 | A | * | 5/1985 | Obara | 446/95 |
| 4,617,001 | A | * | 10/1986 | Parein | 446/102 |
| 4,708,683 | A | * | 11/1987 | Lehmann et al. | 446/75 |
| 5,209,693 | A | * | 5/1993 | Lyman | 446/104 |
| 5,924,910 | A | * | 7/1999 | Liu | 446/470 |

FOREIGN PATENT DOCUMENTS

| | | | | |
|---|---|---|---|---|
| DE | 3700947 | A1 * | 7/1988 | A63H/17/26 |
| DE | 29701360 | U1 * | 4/1997 | A63H/17/05 |
| EP | 0044148 | A1 * | 1/1982 | A63H/17/05 |

* cited by examiner

*Primary Examiner*—Derris H. Banks
*Assistant Examiner*—Urszula M Cegielnik
(74) *Attorney, Agent, or Firm*—Renner, Otto, Boisselle & Sklar, LLP

(57) ABSTRACT

A toy vehicle (10) comprising a part (12) resembling a truck tractor, a part (14) resembling a truck trailer and a pivotal connection (16) therebetween. The pivotal connection (16) is positioned between a platform portion (20) of the tractor part (12) and a front portion (22) of the trailer part (14) that extend over the tractor's platform portion (20). The pivotal connection (16) includes a recess-and-projection arrangement allowing pivotal movement between the tractor part (12) and the trailer part (14), and a groove-projection arrangement limiting the maximum turning radius between the tractor part (12) and the trailer part (14).

26 Claims, 3 Drawing Sheets

TOY TRUCK

RELATED APPLICATION

This application claims priority under 35 U.S.C. §119(e) to U.S. Provisional Patent Application No. 60/419,925 filed on Oct. 21, 2002. The entire disclosure of this earlier application is hereby incorporated by reference.

FIELD OF THE INVENTION

This invention relates generally as indicated to a toy truck and, more particularly, to a toy truck having a part resembling a truck tractor, a part resembling a truck trailer, and a pivotal connection therebetween.

BACKGROUND OF THE INVENTION

A toy truck is a popular item with a child as he/she is learning to move and manipulate rolling items across different surfaces and terrains. Typically, a toy truck has a part resembling a truck tractor, a part resembling a truck trailer and a pivotal connection therebetween. The tractor part usually has a front portion shaped like a chassis and cab body and a platform portion extending rearwardly therefrom. The trailer part usually has a front portion that extends over the tractor's platform portion and a rear portion extending rearwardly therefrom. The pivotal connection is commonly positioned between the tractor's platform portion and the trailer's front portion. A child can control the truck's movement by pulling or pushing the tractor part, with the pivotal connection allowing the trailer part to pivot relative to the tractor part so that the toy truck can turn corners and accomplish other maneuvers.

SUMMARY OF THE INVENTION

The present invention provides a toy truck that provides a secure but child-compatible connection between the tractor part and the trailer part, limits the maximum turn of the tractor part relative to the trailer part, and/or guards connection components against unnecessary wear-and-tear when the trailer part is detached from the tractor part.

More particularly, the present invention provides a toy truck wherein the pivotal connection includes a recess on either the tractor part or the trailer part and a pivot-projection on the other part. The pivot projection comprises a stem and a capture head having a wide portion and a distal portion tapering inwardly from the wide portion. A passageway leads to the recess and the passageway includes an inlet wider than the wide portion of the pivot projection, a resilient outlet slightly less wide (in a relaxed state) than the wide portion of the pivot projection, and a tapering wall therebetween. These features facilitate the initial mating between the capture head and the passageway, ease the outward urging of the resilient outlet during connection steps, and prevent inadvertent detachment of the parts when, for example, the child lifts the toy truck by only its trailer part.

The present invention additionally or alternatively provides a toy truck wherein the pivotal connection includes a projection-and-groove arrangement which limits the range of relative pivotal movement of the tractor and trailer parts and thus dictates a maximum turn position for the toy truck. This arrangement provides a finger gap (e.g., 0.50 inches or more) between the most-adjacent side faces of the tractor part and the trailer part, respectively, when the toy truck is at a maximum turn position. In this manner, a child has the option of grasping the tractor part by placing his/her fingers in this finger gap.

The present invention further provides a toy truck wherein projection components of the pivotal connection (e.g., the pivot projection and/or the turn-limiting projection) are contained within a projection-protecting space. Specifically, the projection(s) are recessed relative to a line extending from the ground-contacting front edge of the tractor part to a ground-contacting point of the truck's rear wheels. This positioning prevents the projections from contacting the ground and suffering unnecessary wear-and-tear if, for example, the child pushes the detached trailer part across the floor or other surface.

These and other features of the invention are fully described and particularly pointed out in the claims. The following description and annexed drawings set forth in detail a certain illustrative embodiment of the invention, this embodiment being indicative of but one of the various ways in which the principles of the invention may be employed.

DRAWINGS

DETAILED DESCRIPTION

Figure 1:
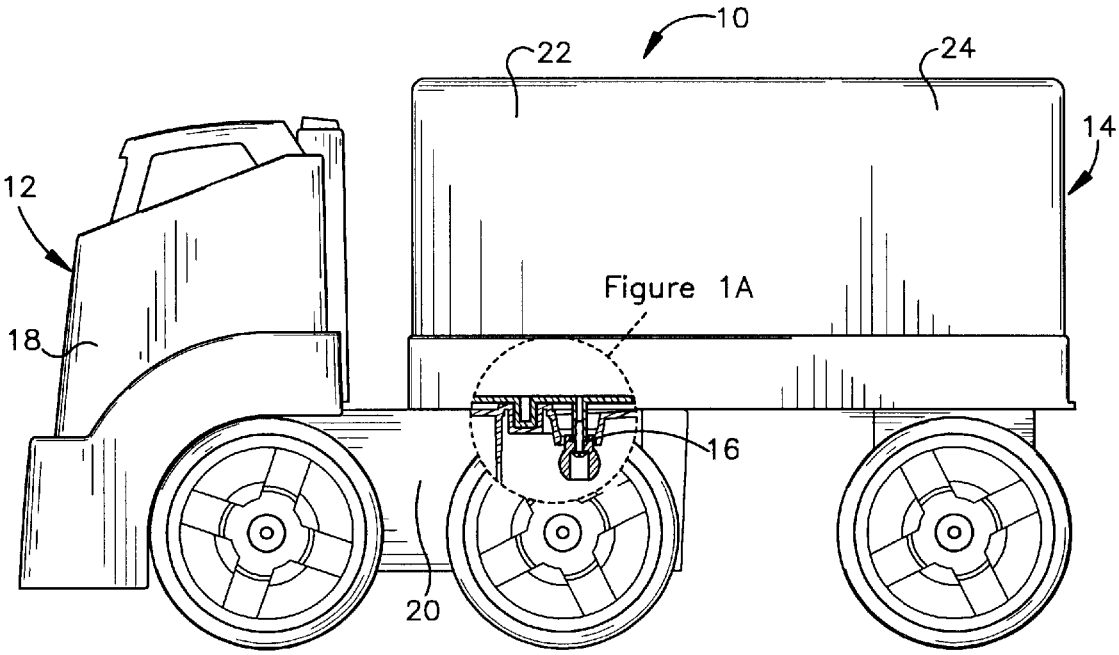
FIG. 1 is a side elevational view of a toy truck according to the present invention with the pivotal connection being shown in section.

Referring now to the drawings in detail, and initially to FIG. 1, a toy truck 10 according to the present invention is shown. The toy truck 10 has a part 12 resembling a truck tractor, a part 14 resembling a truck trailer and a pivotal connection 16 therebetween. In the illustrated embodiment, the toy truck 10 is meant to mimic an ordinary semi tractor and trailer whereby the shape and painting of the parts 12 and 14 resemble the tractor and trailer of such a truck. If the toy truck 10 was instead meant to mimic a fire truck, a dump truck, a fuel-carrying truck, a mixer, a camper, a motorcycle or car hauler, a wrecker, or other type of truck or vehicle, the shape and painting of the parts 12 and 14 would be correspondingly changed to resemble such a truck.

The tractor part 12 has a front cab portion 18 and a platform portion 20 extending rearwardly therefrom and preferably configured to represent the "fifth wheel" of a tractor and trailer rig. The trailer part 14 has a front portion 22 that extends over the tractor's platform portion 20 and a rear portion 24 extending rearwardly therefrom. The pivotal connection 16 is positioned between the tractor platform portion 20 and the trailer front portion 22. A child can control the truck's movement by pulling or pushing the tractor part 14. The pivotal connection 16 allows the trailer part 14 to pivot relative to the tractor part 14, so that the toy truck 10 can turn corners and accomplish other maneuvers.

Figure 1A:
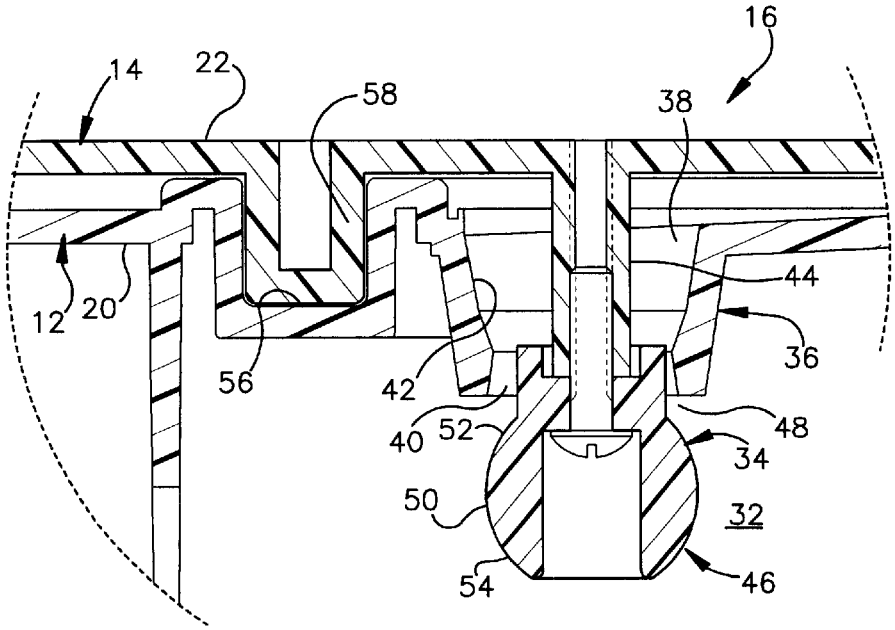
FIG. 1A is an enlarged view of the corresponding portion of FIG. 1.

Referring now additionally to FIG. 1A, the pivotal connection 16 between the tractor part 12 and the trailer part 14 can be more clearly seen. The pivotal connection 16 comprises a projection-receiving recess 32 and a pivot projection 34. In the illustrated embodiment, the recess 32 is formed by the tractor part 12 and the projection 34 is attached to the trailer part 14; however, this arrangement could be reversed if necessary or desired.

The illustrated recess 32 is formed by the empty space under the platform portion 20 of the tractor part 12 and a passageway 36 leads thereinto. The passageway 36 is preferably formed integrally with the platform portion 20 and includes an inlet 38, a resilient outlet 40, and a tapered wall 42 extending therebetween. The inlet 38 forms defines an opening somewhat wider than the widest portion of the projection 34 and the outlet 40, in a relaxed state, defines an opening slightly less than the projection's widest portion. The resilient outlet 40 can be formed in any suitable manner. In the illustrated preferred embodiment, the outlet 40 is formed by a lower edge portion of the passageway 36 having circumferentially spaced apart axial slots. The slots open to the end of the of the passageway 36 and define therebetween a plurality of resilient fingers. Preferably, the tapered wall 42 has a first slope which translates into a steeper second slope before terminating at the outlet 40.

The illustrated projection 34 comprises a stem 44 and a capture head 46 attached to the distal end thereof. The stem 44 is preferably formed integrally with the front portion 22 of the trailer part 14 and extends perpendicularly downwardly from the bottom surface of this portion. The capture head 46 can be a separate molded piece which is attached to the stem 44 with, for example, a rivet (not specifically shown) or other suitable fastening device. The length of the stem 44 determines the position of the capture head 46 relative to the passageway outlet 40 when the bottom surface of the trailer 14 rests flush against the top surface of the tractor's platform portion 20. Specifically, the stem 44 can be dimensioned to define a clearance 48 which allows the trailer part 14 to be elevated relative to the tractor part 12 should the child be moving the toy truck 10 along an uneven terrain, such as a bumpy backyard or a hilly sandbox.

In the illustrated embodiment, the capture head 46 has a spherical shape whereby it has a widest portion 50 (i.e., at its approximate center), a proximate portion 52 tapering outwardly towards the widest portion 50, and a distal portion 54 tapering inwardly towards the stem's bottom surface. As is explained in the succeeding paragraph, the head's spherical shape provides certain capturing advantages. However, other non-spherical geometries having a wide portion and appropriately tapering portions on either side thereof are possible with, and contemplated by, the present invention. In fact, certain advantages may be gained by just a wide portion and a tapering portion which slopes inwardly towards the bottom of the capture head 46. Preferably, the bottom of the capture head 46 has a width which is at least 80% less, at least 75% less, and/or at least 70% less than width of the widest portion 50. Likewise, the shoulder between the top of the capture head 46 and the stem 44 preferably has a width which is at least 80% less, at least 75% less, and/or at least 70% less than width of the widest portion 50.

The pivotal connection 16 is accomplished by the child manipulating the parts 12 and 14 so that the capture head 46 drops into the passageway 36 and then pushing downward on the trailer part 14 (and/or upwardly on the tractor part 12) so that the passageway's outlet 40 is temporarily urged radially outwardly. Once the widest portion 50 of the capture head 46 clears the outlet 40, it springs back to its relaxed state thereby capturing the capture head 46 within the recess 32. Specifically, in the illustrated embodiment, the widest portion 50 cams the outlet's resilient fingers radially outward and, after the capture head 46 clears the fingers, they spring back to restrict reverse passage of the projection 34 through the outlet 40. To disconnect, the child pulls the parts 12 and 14 away from each other and the widest portion of the capture head 46 urges the outlet 40 radially outward to release the projection 32 from the recess 30.

The tapering portions 52 and 54 of the capture head 46, and/or the intermediate positioning of the capture head's widest portion 50, facilitate the initial insertion of the capture head 46 into the passageway 36 and also facilitate the urging of the outlet 40 radially outward during both connecting and disconnecting steps. Additionally, the geometry of the passageway 36 and/or the capture head 46 provides a secure connection thereby preventing inadvertent detachment when, for example, the child lifts the toy truck 10 by only its trailer part 14. Furthermore, the upper tapering portion 52 of the capture head 46 (above its widest portion 50) increases the head-to-passageway clearance 48 to provide for additional relative elevation of the trailer part 14 when the toy truck 10 is being moved across an uneven terrain.

The pivotal connection 16 has associated therewith a projection-receiving groove 56 and a turn-limiting projection 58. In the illustrated embodiment, the groove 56 is formed by the tractor part 12 and the projection 58 is attached to the trailer part 14 and both are integrally formed (e.g., molded) with their respective parts. However, a reverse arrangement (i.e., the groove 56 on the trailer part 14 and the projection 58 on the tractor part 12) and/or a separate projection suitably attached to the appropriate part 12/14, are possible with and contemplated by the present invention.

Figure 2:
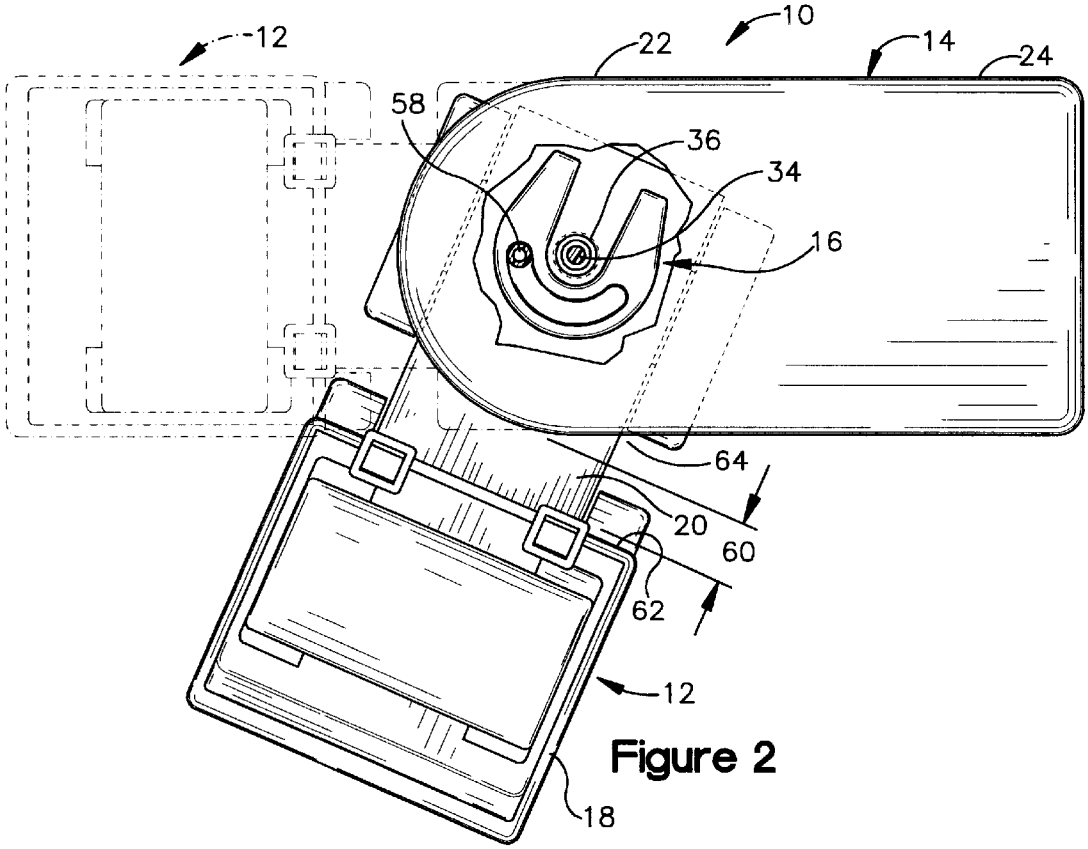
FIG. 2 is a top view of the toy truck.
Figure 2A:
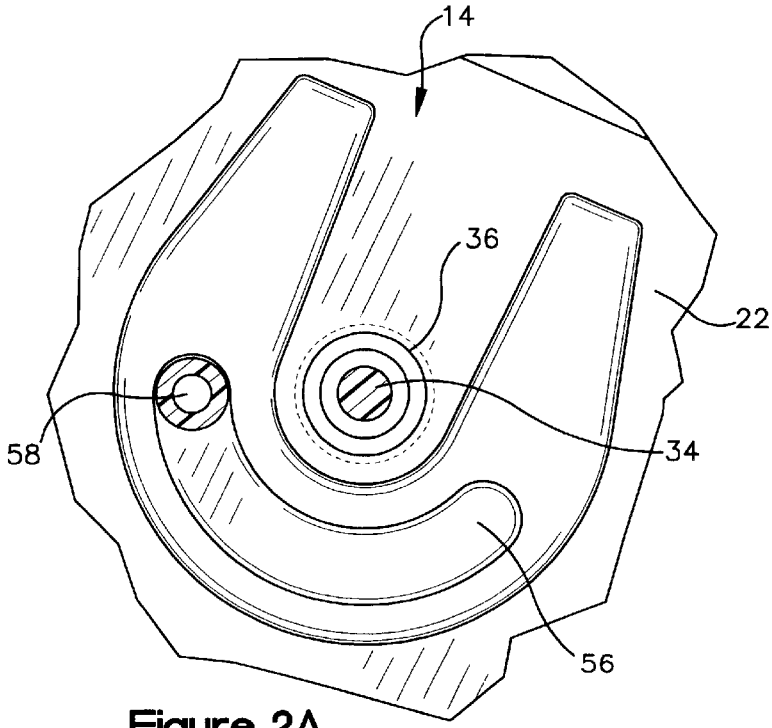
FIG. 2A is an enlarged view of the corresponding portion of FIG. 2.
Figure 3:
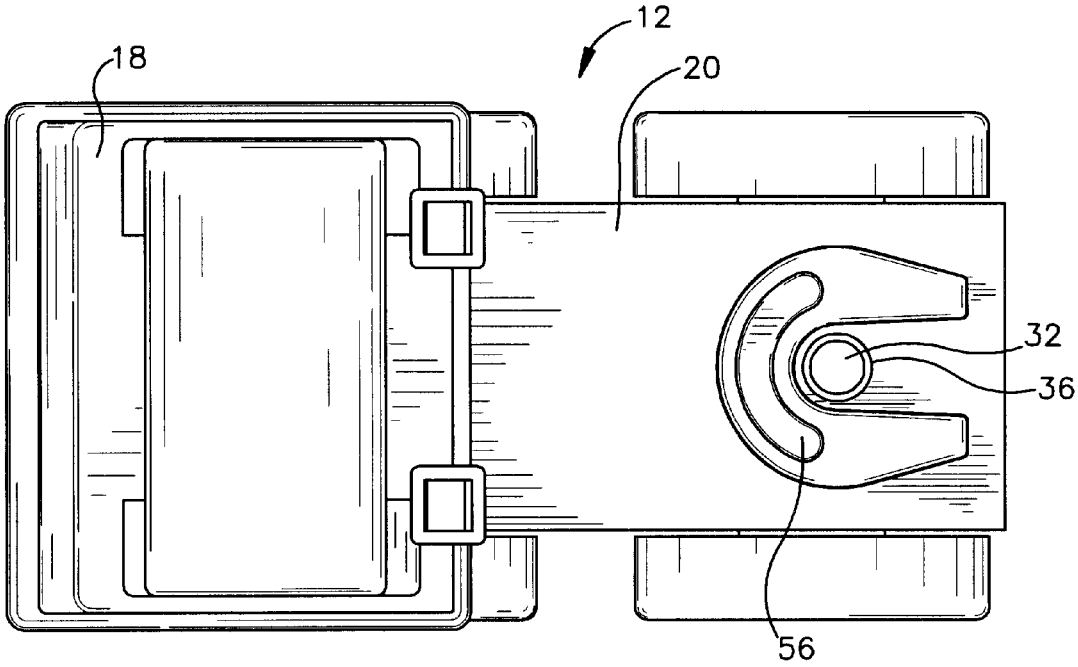
FIG. 3 is a top view of the tractor part of the toy truck.

As is best seen by referring additionally to FIGS. 2 and 3, the groove 56 has an arc-shape having a lateral center aligned with the passageway 36 and the projection 58 fits within the groove 56 for sliding movement therein. In the illustrated embodiment, the groove 56 is positioned forward of the recess 32 and curves therearound. (See also FIG. 2A.) The groove 56 provides an almost 180° turning arc for the toy truck, although different turning parameters could be dictated by changing the geometry of the groove 56. The groove 56 is preferably shallower than the passageway 36 and the turn-limiting projection 58 is preferably shorter than the pivot projection 34. (See FIG. 1A.) During connection of the pivot projection 34 into the recess 30, the projection 58 is essentially automatically mated with the groove 56. Accordingly, this added feature of the pivotal connection 16 does not complicate connection or disconnection of the parts 12 and 14.

The groove-and-projection arrangement dictates the maximum turn of the trailer part 14 relative to the tractor part 12. Preferably, this arrangement is designed to provide a finger gap 60 between the most-adjacent side faces 62 and 64 of the tractor part 12 and the trailer part 14, respectively, when the toy truck 10 is at a maximum turn position. (See FIG. 2.) In the illustrated embodiment, the most adjacent surfaces are the back wall of the front portion 18 of the tractor part and the lateral wall of the front portion 22 of the trailer part 14. In any event, the finger gap 60 is dimensioned (e.g., at least 0.5 inches and/or at least 0.75 inches) to provide the child with enough space so that he/she could have the option of grasping the tractor part 16 in this area.

Figure 4:
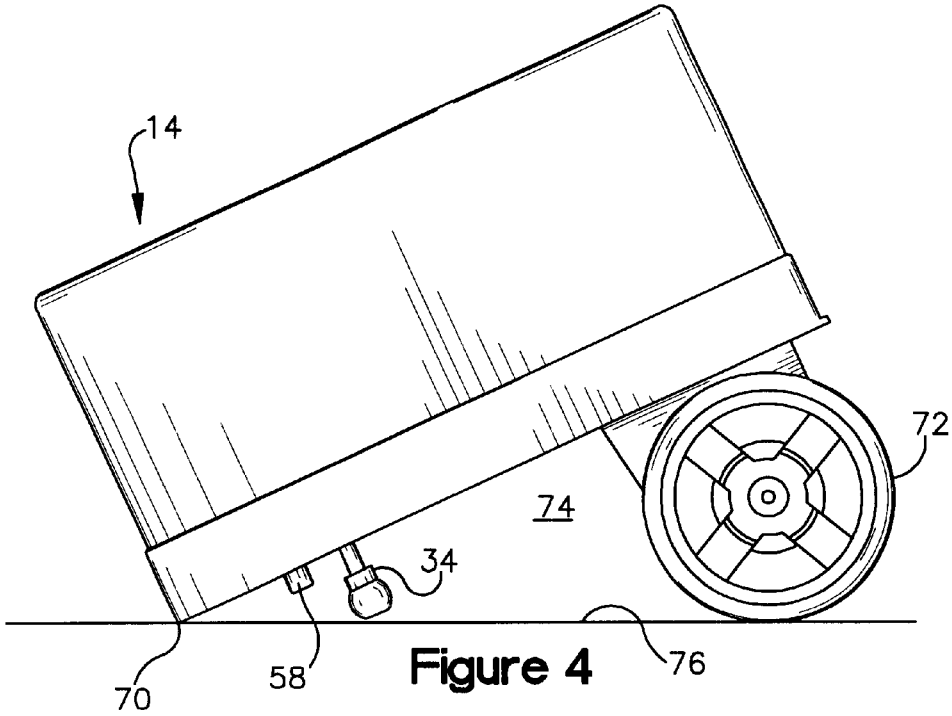
FIG. 4 is a side view of the trailer part detached from the trailer part.

Referring now to FIG. 4, the trailer part 14 is shown detached from the tractor part 12. In this detached condition, the trailer's front edge 70 rests upon the ground and the truck's rear wheels 72 elevate the rear of the trailer part 14 upward. A line 76 extends from the trailer's front edge 70 to the ground-contacting point of the wheels 72 and the projections 34 and 56 are recessed relative to this line 76. This positioning of the projections 34 and 58 (and particularly the pivot pin 34 since it is longer) protects them from contacting the ground and suffering unnecessary wear-and-tear if, for example, the child pushes the detached trailer part 14 across the floor.

One may now appreciate that present invention provides a toy truck 10 having a secure but child-compatible connection between the tractor part 12 and the trailer part 14, limits the maximum turn of the tractor part 12 relative to the trailer part 14, and/or protects projections 34/58 against unnecessary wear-and-tear when the trailer part 14 is detached from the tractor part 12.

Although the invention has been shown and described with respect to certain preferred embodiments, it is obvious that equivalent and obvious alterations and modifications will occur to others skilled in the art upon the reading and understanding of this specification. The present invention includes all such alterations and modifications.

What is claimed is:

1. A toy vehicle comprising:

a tractor part having a front portion and a platform portion extending rearwardly therefrom;

a trailer part having a front portion that extends over the tractor's platform portion and a rear portion extending rearwardly therefrom;

a pivotal connection positioned between the tractor's platform portion and the trailer's front portion; and a projection-and-groove arrangement, which dictates a maximum turn position for the toy vehicle;

wherein the projection-and-groove arrangement provides a finger gap between most-adjacent side faces of the tractor part and the trailer part, respectively, when the toy vehicle is at a maximum turn position.

2. A toy vehicle as set forth in claim 1, wherein the finger gap has a width of at least 0.50 inches.

3. A toy vehicle as set forth in claim 2, wherein the finger gap has a width of at least 0.75 inches.

4. A toy vehicle as set forth in claim 1, wherein the projection-and-groove arrangement comprises an arc-shaped groove and a turn-limiting projection which fits slidingly within the groove.

5. A toy vehicle as set forth in claim 4, wherein the groove is formed by the tractor part and wherein the projection is attached to the trailer part.

6. A toy vehicle as set forth in claim 5, wherein at least one of the groove and the projection is integrally formed with its respective parts.

7. A toy vehicle as set forth in claim 4, wherein the groove provides an almost 180° turning arc for the toy vehicle.

8. A toy vehicle comprising:

a tractor part having a front portion, and a platform portion extending rearwardly therefrom;

a trailer part having a front portion that extends over the tractor's platform portion and a rear portion extending rearwardly therefrom; and a pivotal connection positioned between the tractor's platform portion and the trailer's front portion, the pivotal connection including a recess on one of the tractor part and the trailer part and a pivot-projection on the other of the tractor part and the trailer part, and wherein:

the pivot projection comprises a stem and a capture head having a wide portion and a distal portion tapering inwardly from the wide portion; and a passageway leads to the recess and the passageway includes an inlet wider than the wide portion of the pivot projection, and a resilient outlet slightly less wide, in a relaxed state, than the wide portion of the pivot projection.

9. A toy vehicle as set forth in claim 8, wherein the bottom of the capture head has a width which is at least 80% less than the width of the wide portion.

10. A toy vehicle as set forth in claim 9, wherein the bottom of the capture head has a width which is at least 75% less than the width of the wide portion.

11. A toy vehicle as set forth in claim 10, wherein the bottom of the capture head has a width which is at least 70% less than the width of the wide portion.

12. A toy vehicle as set forth in claim 11, wherein the capture head also comprises a proximate portion tapering outwardly towards the wide portion.

13. A toy vehicle as set forth in claim 12, wherein the shoulder between the proximate portion and the stem has a width which is at least 80% less than the width of the wide portion.

14. A toy vehicle as set forth in claim 13, wherein the shoulder between the proximate portion and the stem has a width which is at least 75% less than the width of the wide portion.

15. A toy vehicle as set forth in claim 14, wherein the shoulder between the proximate portion and the stem has a width which is at least 70% less than the width of the wide portion.

16. A toy vehicle as set forth in claim 8, wherein the capture head has a substantially spherical shape.

17. A toy vehicle as set forth in claim 8, wherein the stem is dimensioned to define a clearance between the capture head and the outlet of the passageway thereby allowing the trailer part to be elevated relative to the tractor part should the child be moving the toy vehicle along an uneven terrain.

18. A toy vehicle as set forth in claim 8, wherein the recess is formed by an empty space below the platform portion of the tractor part.

19. A toy vehicle as set forth in claim 8, wherein the pivotal connection also comprises a projection-and-groove arrangement which dictates a maximum turn position for the toy vehicle.

20. A toy vehicle as set forth in claim 19, wherein the projection-and-groove arrangement provides a finger gap between the most-adjacent side faces of the tractor part and the trailer part, respectively, when the toy vehicle is at a maximum turn position.

21. A toy vehicle comprising:

a tractor part having a front portion, and a platform portion extending rearwardly therefrom;

a trailer part having a front portion that extends over the tractor's platform portion and a rear portion extending rearwardly therefrom; and a pivotal connection positioned between the tractor's platform portion and the trailer's front portion, the pivotal connection including a projection-and-recess arrangement which allows pivotal movement between the tractor part and the trailer part and a projection-and-groove arrangement which dictates a maximum turn position for the toy vehicle;

wherein the projection-and-groove arrangement provides a finger gap between most-adjacent side faces of the tractor part and the trailer part, respectively, when the toy vehicle is at a maximum turn position.

22. A toy vehicle as set forth in claim 21, wherein the projection-and-recess arrangement comprises a recess formed on the tractor part and a pivot-projection attached to the trailer part, and wherein the projection-and-groove arrangement comprises a groove formed on the tractor part and a turn-limiting projection attached to the tractor part.

23. A toy vehicle as set forth in claim 22, wherein the groove is positioned forward of the recess and curves therearound.

24. A toy vehicle as set forth in claim 22, wherein the groove is shallower than the recess and wherein the turn-limiting projection is shorter than the pivot projection.

25. A toy vehicle comprising:

a tractor part having a front portion and a platform portion extending rearwardly therefrom;

a trailer part having a front portion that extends over the tractor's platform portion and a rear portion extending rearwardly therefrom; and a pivotal connection positioned between the tractor's platform portion and the trailer's front portion, the pivotal connection including a recess formed on the tractor part and a pivot-projection attached to the trailer part for receipt into the recess;

wherein the pivot-projection is recessed relative to a line extending from a ground-contacting front edge of the tractor part to a ground-contacting point of rear wheels of the vehicle whereby, when the trailer part is detached from the tractor part, the pivot-projections will be protected from contacting the ground.

26. A toy vehicle as set forth in claim 25, further comprising a projection-and-groove arrangement, which dictates a maximum turn position for the toy vehicle and which includes a projection attached to the trailer part, and wherein this projection is also is recessed relative to the line extending from the ground-contacting front edge of the tractor part to the ground-contacting point of the rear wheels of the vehicle whereby, when the trailer part is detached from the tractor part, this projection will also be protected from contacting the ground.

* * * * *